US007689138B2

(12) United States Patent
Tanaka

(10) Patent No.: US 7,689,138 B2
(45) Date of Patent: Mar. 30, 2010

(54) PRINTING CONTROL APPARATUS, PRINTING APPARATUS, PRINTING CONTROL METHOD, PRINTING CONTROL PROGRAM, AND MEDIUM FOR RECORDING THE PRINTING CONTROL PROGRAM

(75) Inventor: Yoshiaki Tanaka, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 864 days.

(21) Appl. No.: 11/229,273

(22) Filed: Sep. 16, 2005

(65) Prior Publication Data

US 2006/0062587 A1 Mar. 23, 2006

(30) Foreign Application Priority Data

Sep. 17, 2004 (JP) ..... P2004-272295

(51) Int. Cl.
*G03G 15/00* (2006.01)

(52) U.S. Cl. ..... 399/75

(58) Field of Classification Search ..... 399/75, 399/8, 9, 45, 391, 392
See application file for complete search history.

(56) References Cited

U.S. PATENT DOCUMENTS 5,742,327 A * 4/1998 Igarashi ..... 347/262
6,304,342 B1 * 10/2001 Komada ..... 358/448
6,654,137 B1 * 11/2003 Yagita ..... 358/1.15

FOREIGN PATENT DOCUMENTS

JP 08-090846 4/1996
JP 2004102960 A * 4/2004
JP 2004334579 A * 11/2004

* cited by examiner

*Primary Examiner*—David M Gray
*Assistant Examiner*—Andrew V Do
(74) *Attorney, Agent, or Firm*—David G. Conlin; Steven M. Jensen; Edwards Angell Palmer & Dodge LLP

(57) ABSTRACT

A printing control apparatus that succeeds in providing enhanced usability by giving a paper placement opportunity to users so that an operational burden can be reduced is provided. A printer control section controls a printing section to effect print standby with respect to one of a plurality of image-data pages that has been subjected to print-standby specification first by a standby specification command. After a sensor of a manual feeding tray in the printing section detects placement of a new sheet, the printing section is so controlled as not to effect print standby with respect to the remainder of the pages even if standby is specified by a standby specification command.

14 Claims, 10 Drawing Sheets

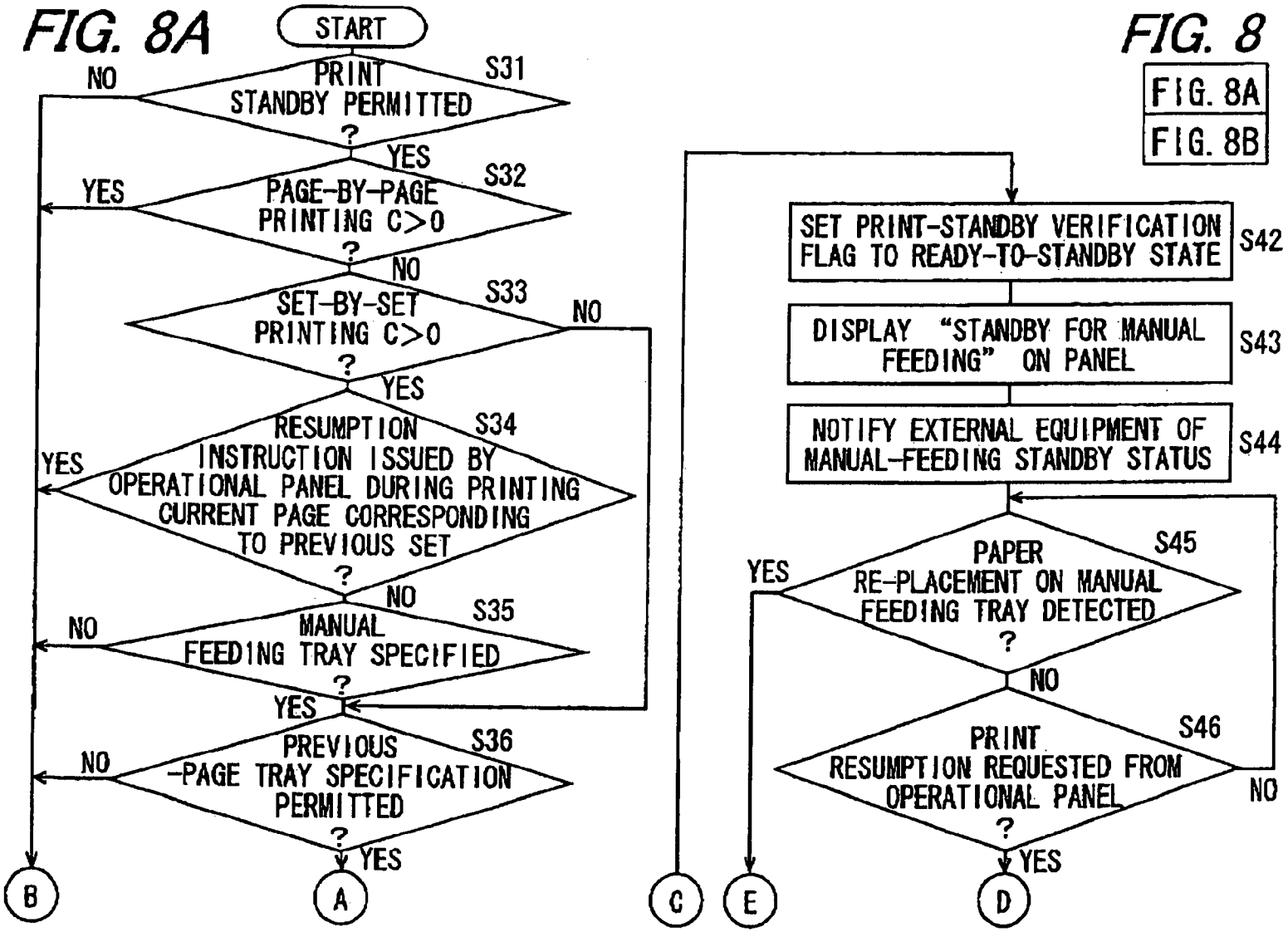
FIG. 8
FIG. 8A
FIG. 8B
FIG. 8A
START
S31
PRINT STANDBY PERMITTED ?
S32
PAGE-BY-PAGE PRINTING C>0 ?
S33
SET-BY-SET PRINTING C>0 ?
S34
RESUMPTION INSTRUCTION ISSUED BY OPERATIONAL PANEL DURING PRINTING CURRENT PAGE CORRESPONDING TO PREVIOUS SET ?
S35
MANUAL FEEDING TRAY SPECIFIED ?
S36
PREVIOUS -PAGE TRAY SPECIFICATION PERMITTED ?
YES
NO
A
B
S42
SET PRINT-STANDBY VERIFICATION FLAG TO READY-TO-STANDBY STATE
S43
DISPLAY "STANDBY FOR MANUAL FEEDING" ON PANEL
S44
NOTIFY EXTERNAL EQUIPMENT OF MANUAL-FEEDING STANDBY STATUS
S45
PAPER RE-PLACEMENT ON MANUAL FEEDING TRAY DETECTED ?
S46
PRINT RESUMPTION REQUESTED FROM OPERATIONAL PANEL ?
C
D
E

FIG. 9

STANDBY FOR MANUAL FEEDING

TO CONTINUE PRINTING, PLEASE SET THE FOLLOWING SHEET AND THEN PRESS OK BUTTON

14

A4 : PLAIN PAPER

OK

FIG. 10

STANDBY FOR MANUAL FEEDING

PLEASE SET THE FOLLOWING SHEET ON MANUAL FEEDING TRAY OF PRINTER

22

A4 : PLAIN PAPER

PRINTING CONTROL APPARATUS, PRINTING APPARATUS, PRINTING CONTROL METHOD, PRINTING CONTROL PROGRAM, AND MEDIUM FOR RECORDING THE PRINTING CONTROL PROGRAM

BACKGROUND OF THE INVENTION

1. Field of the Invention

The present invention relates to a printing control apparatus for exercising paper-feeding control in a printing apparatus equipped with a paper feeding tray which is capable of stocking a plurality of sheet-like recording media, as well as to a printing apparatus, a printing control method, a printing control program, and a recording medium for storing thereon the printing control program.

2. Description of the Related Art

In order to operate a printer to put out an image generated by a personal computer (PC), a command for performing printing (hereafter referred to simply as "printing command") and image data need to be transmitted from the PC to the printer. The printing command includes a variety of specification instruction commands such as a command to specify a paper tray, a command to specify a paper size, and a command to specify a paper type.

The software application installed in the PC allows a user to specify a paper tray with respect to a print target carrying image data on a page-by-page basis. Specifically, by means of a printer driver, a command to specify a paper tray is transmitted to the printer in accordance with the instruction issued by the software application. In this connection, Japanese Unexamined Patent Publication JP-A 8-90846 (1996) discloses the invention of a technique for making paper-tray specification on a page-by-page basis by means of a print buffer device connected between a printer and a PC.

In the case of creating a networked environment by connecting together a plurality of PCs, a printer, and a printing control apparatus so as for a plurality of users to share the printer, typified by LAN (Local Area Network) for instance, chances are high that requests on paper for use in printing vary from user to user. In this case, if the printer has only a few paper trays, the user has to place a desired paper sheet on a manual feeding tray before starting a printing operation. In a printing control apparatus of conventional design, a printing operation is temporarily halted only when a standby condition that is necessary to select a manual-feeding mode (hereafter referred to simply as "manual-feeding standby") is specified with respect to the first page of a print target under print job issued by external equipment such as a PC. This gives the user an opportunity to place a desired paper sheet on the tray.

Moreover, in a printing control apparatus designed to control a printer of the type that performs printing with only a single piece of paper placed on a manual feeding tray, when a manual feeding tray-printing mode is specified, a printing operation will be temporarily halted every time specification is made.

In a print job for printing a plurality of pages, when manual-feeding standby is specified with respect to the second and later pages, the printing operation will not be temporarily halted. In this case, the user has no chance to place a paper sheet. On the other hand, in a conventional printing control apparatus of another type, a printing operation is temporarily halted every time a manual feeding tray is specified. This requires the user to place a paper sheet every time a printing operation comes to a halt.

SUMMARY OF THE INVENTION

An object of the invention is to provide a printing control apparatus that succeeds in providing enhanced usability by giving a paper placement opportunity to users so that an operational burden can be reduced, and also provide a printing apparatus, a printing control method, a printing control program, and a recording medium for storing thereon the printing control program.

The invention provides a printing control apparatus that receives a printing command associated with a printing operation and image data extending over a plurality of pages of a print target and exercise paper-feeding control based on the printing command received, to a printing apparatus equipped with a paper feeding tray capable of stocking a plurality of sheet-like recording media, the printing command including a standby specification command for allowing a print-standby condition to be specified with respect to the image data on a page-by-page basis, the printing control apparatus comprising:

detection means for detecting an instruction to resume printing which is on standby because of specification of the print-standby condition by the standby specification command; and control means for controlling the printing apparatus in such a way that print standby is effected with respect to one of a plurality of image-data pages that has been subjected to print-standby specification in the first place by the standby specification command, and, after a print resumption instruction is detected, print standby is not effected with respect to the image-data pages of the second and later copies even if standby is specified by a standby specification command.

According to the invention, the printing control apparatus receives a printing command associated with a printing operation and image data extending over a plurality of pages of a print target and exercise paper-feeding control based on the printing command received, to a printing apparatus equipped with a paper feeding tray capable of stocking a plurality of sheet-like recording media.

The printing command includes the standby specification command for allowing the print-standby condition to be specified with respect to the image data on a page-by-page basis. The control means controls the printing apparatus in such a way that print standby is effected with respect to one of a plurality of the image-data pages that has been subjected to print-standby specification in the first place at the standby specification command.

After an instruction to resume printing on standby is detected by the detection means, the control means controls the printing apparatus in such a way that print standby is not effected with respect to the image-data pages of the second and later copies regardless of specification by the standby specification command.

In this way, print standby is effected before printing the page subjected to print-standby specification in the first place, and, after a print resumption instruction is issued by the user through changing of the sheet-like recording medium or other actions, print standby is not effected even if the print-standby condition is specified with respect to the remainder of the pages. This helps reduce an operational burden imposed on the user to issue the print resumption instruction.

In the invention, it is preferable that the control means controls the printing apparatus in such a way that, only when the print-standby condition is specified with respect to a page next to the page to which standby has been specified in the first place, print standby is not effected with respect to the next page regardless of specification by the standby specification command.

Moreover, according to the invention, the control means controls the printing apparatus in such a way that, only when the print-standby condition is specified with respect to a page next, to the page to which standby has been specified in the first place, print standby is not effected with respect to the next page regardless of specification by the standby specification command.

In this way, when the print-standby condition is not specified with respect to the next page, standby is effected so that the user is given an opportunity to change the sheet-like recording medium.

In the invention, it is preferable that the printing command includes a medium condition setting command for setting a condition as to a sheet-like recording medium, and that the control means controls the printing apparatus in such a way that, only when the page to which standby has been specified in the first place by the standby specification command and pages subsequent thereto are equal in condition setting by a medium condition setting command, print standby is not effected with respect to the subsequent pages regardless of specification by the standby specification command.

Moreover, according to the invention, the printing command includes the medium condition setting command for setting conditions as to the sheet-like recording medium. Moreover, the control means controls the printing apparatus in such a way that, only when the page to which standby has been specified in the first place by the standby specification command and pages subsequent thereto are equal in condition setting by a medium condition setting command, print standby is not effected with respect to the subsequent pages even if standby is specified by a standby specification command.

In the case where the page to which standby has been specified in the first place and pages subsequent thereto are equal in sheet-like recording medium condition, it can be judged that the user has already finished necessary operations, such as sheet-like recording medium changing, at that point in time when print standby was effected before printing the page to which standby has been specified in the first place. Hence, the remainder of the pages are not subjected to standby, whereby making it possible to reduce an operational burden imposed on the user to issue the print resumption instruction.

In the invention, it is preferable that the condition refers to the size of the sheet-like recording medium.

Moreover, according to the invention, for example, the sheet-like recording medium condition refers to the size of the sheet-like recording medium such as A3, A4, and B5.

In the case of specifying sheet-like recording media of different sizes for a printing operation, unless print standby is effected, it will be inevitable that, for example, image data corresponding to an A3-sized sheet is forcibly printed on an A4-sized sheet-like recording medium. This gives rise to a problem that only part of the image data is printed successfully. However, according to the invention, in the case of specifying sheet-like recording media of different sizes, as described above, print standby is also effected with respect to the pages subsequent to the page to which standby has been specified in the first place. This helps prevent occurrence of such a problem.

In the invention, it is preferable that the condition refers to a type of the sheet-like recording medium.

Moreover, according to the invention, the sheet-like recording medium condition refers to the type of the sheet-like recording medium such as plain paper, calendered paper (gloss paper), or overhead transparency film (OHP sheet).

In the case of specifying sheet-like recording media of different types for a printing operation, unless print standby is effected, it will be inevitable that, for example, image data suited to plain paper is forcibly printed on an OHP sheet. This gives rise to a problem of improper image processing. However, according to the invention, in the case of specifying sheet-like recording media of different types, as described above, print standby is also effected with respect to the pages subsequent to the page to which standby has been specified in the first place. This helps prevent occurrence of such a problem.

The invention provides a printing control apparatus that receives a printing command associated with a printing operation and image data extending over a plurality of pages of a print target and exercise paper-feeding control based on the printing command received, to a printing apparatus equipped with a paper feeding tray capable of stocking a plurality of sheet-like recording media, the printing command including a standby specification command for allowing a print-standby condition to be specified with respect to the image data on a page-by-page basis, the printing control apparatus comprising:

copy number specification means for giving an instruction to the printing apparatus to print a plurality of sets of copies;

detection means for detecting an instruction to resume printing which is on standby because of specification of the print-standby condition by the standby specification command; and control means for controlling the printing apparatus in such a way that print standby is effected with respect to one of a plurality of image-data pages that has been subjected to print-standby specification in the first place by the standby specification command, and, after a print resumption instruction is detected, print standby is not effected with respect to the image-data pages of the second and later copies even if standby is specified by a standby specification command.

Further, according to the invention, the printing control apparatus receives a printing command associated with a printing operation and image data extending over a plurality of pages of a print target so as to exercise paper-feeding control, on the basis of the printing command received, in a printing apparatus equipped with a paper feeding tray which is capable of stocking a plurality of sheet-like recording media.

The printing command includes the standby specification command for allowing the print-standby condition to be specified with respect to the image data on a page-by-page basis. Moreover, in response to an instruction to print a plurality of sets of copies issued by the copy number instruction means, the control means controls the printing apparatus in such a way that print standby is effected with respect to one of a plurality of image-data pages of the first copy that has been subjected to print-standby specification in the first place by the standby specification command.

After an instruction to resume printing on standby is detected by the detection means, the control means controls the printing apparatus in such a way that print standby is not effected with respect to the second and later copies regardless of specification by the standby specification command.

In this way, print standby is effected before printing the page of the first copy subjected to print-standby specification in the first place, and, after a print resumption instruction is issued by the user through changing of the sheet-like recording medium or other actions, print standby is not effected even if the print-standby condition is specified with respect to the corresponding page of the second and later copies. This helps reduce an operational burden imposed on the user to issue the print resumption instruction.

In the invention, it is preferable that the detection means detects, as a print resumption instruction, at least placement of a new sheet-like recording medium on a paper feeding tray, and that the control means controls the printing apparatus in such a way that, when the placement of a new sheet-like recording medium on the paper feeding-tray is detected as an instruction to resume printing a certain page of the first copy, print standby is also effected with respect to the corresponding page of the second and later copies.

Further, according to the invention, when the detection means detects placement of a new sheet-like recording medium on the paper feeding tray as an instruction to resume printing of a certain page of the first copy, the control means controls the printing apparatus in such a way that print standby is also effected with respect to the corresponding page of the second and later copies.

In the case where a new sheet-like recording medium is placed on the paper feeding tray as an instruction to resume printing a certain page of the first copy, it can be judged that changing of the sheet-like recording medium is necessary to print the page. Hence, print standby is also effected with respect to the corresponding page of the second and later copies, whereby making it possible to give the user an opportunity to change the sheet-like recording medium.

In the invention, it is preferable that the control means controls the printing apparatus in such a way that print standby is effected with respect to the page to which standby has been specified in the first place also in the second and later copies.

Further, according to the invention, the control means controls the printing apparatus in such a way that print standby is effected with respect to the page to which standby has been specified in the first place also in the second and later copies.

For example, assuming that a set of tab sheets containing five pages is placed on the paper feeding tray, and that, of the five pages, four pages are subjected to print-standby specification. In this case, a single tab sheet is left over. By effecting print standby on a set-by-set basis, it is possible to give the user an opportunity to remove the tab sheet left over.

In the invention, it is preferable that the printing control apparatus further comprises switching means for allowing selection between permission and prohibition of control action performed by the control means.

Further, according to the invention, the switching means is provided for allowing selection between permission and prohibition of control action performed by the control means.

Thereby, for example, in order for all the image data to be forcedly printed on sheet-like recording media of the same size, all that needs to be done is to prohibit the control action.

In the invention, it is preferable that the control means has notification means for notifying, in a case of effecting print standby, external equipment of readiness for standby.

Further, according to the invention, the control means has notification means for notifying, in the case of effecting print standby, external equipment of readiness for standby.

Thereby, the user is able to recognize at once that the printing apparatus is placed in a standby condition.

The invention provides a printing apparatus incorporating the printing control apparatus mentioned above.

Further, according to the invention, the printing apparatus is characterized by including the printing control apparatus. By virtue of the printing control apparatus, the printing apparatus succeeds in providing enhanced usability.

The invention provides a printing control method comprising the steps of:

receiving a printing command associated with a printing operation and image data extending over a plurality of pages of a print target; and exercising paper-feeding control based on the printing command received, to a printing apparatus equipped with a paper feeding tray capable of stocking a plurality of sheet-like recording media, wherein the printing command includes a standby specification command for allowing a print-standby condition to be specified with respect to the image data on a page-by-page basis, the printing control method further comprising the steps of:

controlling the printing apparatus such that print standby is effected with respect to one of a plurality of image-data pages that has been subjected to print-standby specification in the first place by the standby specification command; and after a print resumption instruction for standby print is detected, controlling the printing apparatus such that print standby is not effected with respect to print standby is not effected with respect to the image-data pages of the second and later copies even if standby is specified by a standby specification command.

Still further, according to the printing control method of the invention, a printing command associated with a printing operation and image data extending over a plurality of pages of a print target are received so as to exercise paper-feeding control, on the basis of the printing command received, in a printing apparatus equipped with a paper feeding tray which is capable of stocking a plurality of sheet-like recording media.

The printing command includes the standby specification command for allowing the print-standby condition to be specified with respect to the image data on a page-by-page basis. The printing apparatus is so controlled that print standby is effected with respect to one of a plurality of image-data pages that has been subjected to print-standby specification in the first place by the standby specification command.

Upon detection of an instruction to resume printing on standby, the printing apparatus is so controlled that print standby is not effected with respect to the image-data pages of the second and later copies regardless of specification by the standby specification command.

In this way, print standby is effected before printing the page to which standby has been specified in the first place, and, after a print resumption instruction is issued by the user through changing of the sheet-like recording medium or other actions, print standby is not effected even if the print-standby condition is specified with respect to the remainder of the pages. This helps reduce an operational burden imposed on the user to issue the print resumption instruction.

The invention provides a printing control method comprising the steps of:

receiving a printing command associated with a printing operation and image data extending over a plurality of pages of a print target; and exercising paper-feeding control based on the printing command received, to a printing apparatus equipped with a paper feeding tray capable of stocking a plurality of sheet-like recording media, wherein the printing command includes a standby specification command for allowing a print-standby condition to be specified with respect to the image data on a page-by-page basis, the printing control method further comprising the steps of:

when printing of a plurality of sets of copies is instructed, controlling the printing apparatus such that print standby is effected with respect to one of a plurality of image-data pages for the first copy that has been subjected to print-standby specification in the first place by the standby specification command; and after an instruction to resume printing on standby has been detected, controlling the printing apparatus such that print standby is not effected with respect to the corresponding page for the second and later copies even if standby is specified by a standby specification command.

Besides, according to the printing control method of the invention, a printing command associated with a printing operation and image data extending over a plurality of pages of a print target are received so as to exercise paper-feeding control, on the basis of the printing command received, in a printing apparatus equipped with a paper feeding tray which is capable of stocking a plurality of sheet-like recording media.

The printing command includes the standby specification command for allowing the print-standby condition to be specified with respect to the image data on a page-by-page basis. Moreover, in response to an instruction to print a plurality of sets of copies, the printing apparatus is so controlled that print standby is effected with respect to one of a plurality of image-data pages of the first copy that has been subjected to print-standby specification in the first place by the standby specification command.

Upon detection of an instruction to resume printing on standby, the printing apparatus is so controlled that print standby is not effected with respect to the corresponding page of the second and later copies regardless of specification by the standby specification command.

In this way, print standby is effected before printing the page of the first copy to which standby has been specified in the first place, and, after a print resumption instruction is issued by the user through changing of the sheet-like recording medium or other actions, print standby is not effected even if the print-standby condition is specified with respect to the corresponding page of the second and later copies. This helps reduce an operational burden imposed on the user to issue the print resumption instruction.

The invention provides a printing control program for use in driving a computer to execute the printing control method mentioned above.

The invention provides a computer-readable recording medium for storing thereon the printing control program for use in driving a computer to execute the printing control method mentioned above.

In addition, according to the invention, there are provided the printing control program for use in driving a computer to execute the printing control method, and a computer-readable recording medium for storing thereon the printing control program.

BRIEF DESCRIPTION OF THE DRAWINGS

Other and further objects, features, and advantages of the invention will be more explicit from the following detailed description taken with reference to the drawings wherein:

FIG. 9 is a view showing an example for display screen on a touch panel LCD;

FIG. 10 is a view showing an example for display screen on a status monitor.

DETAILED DESCRIPTION OF THE PREFERRED EMBODIMENTS

Figure 1:
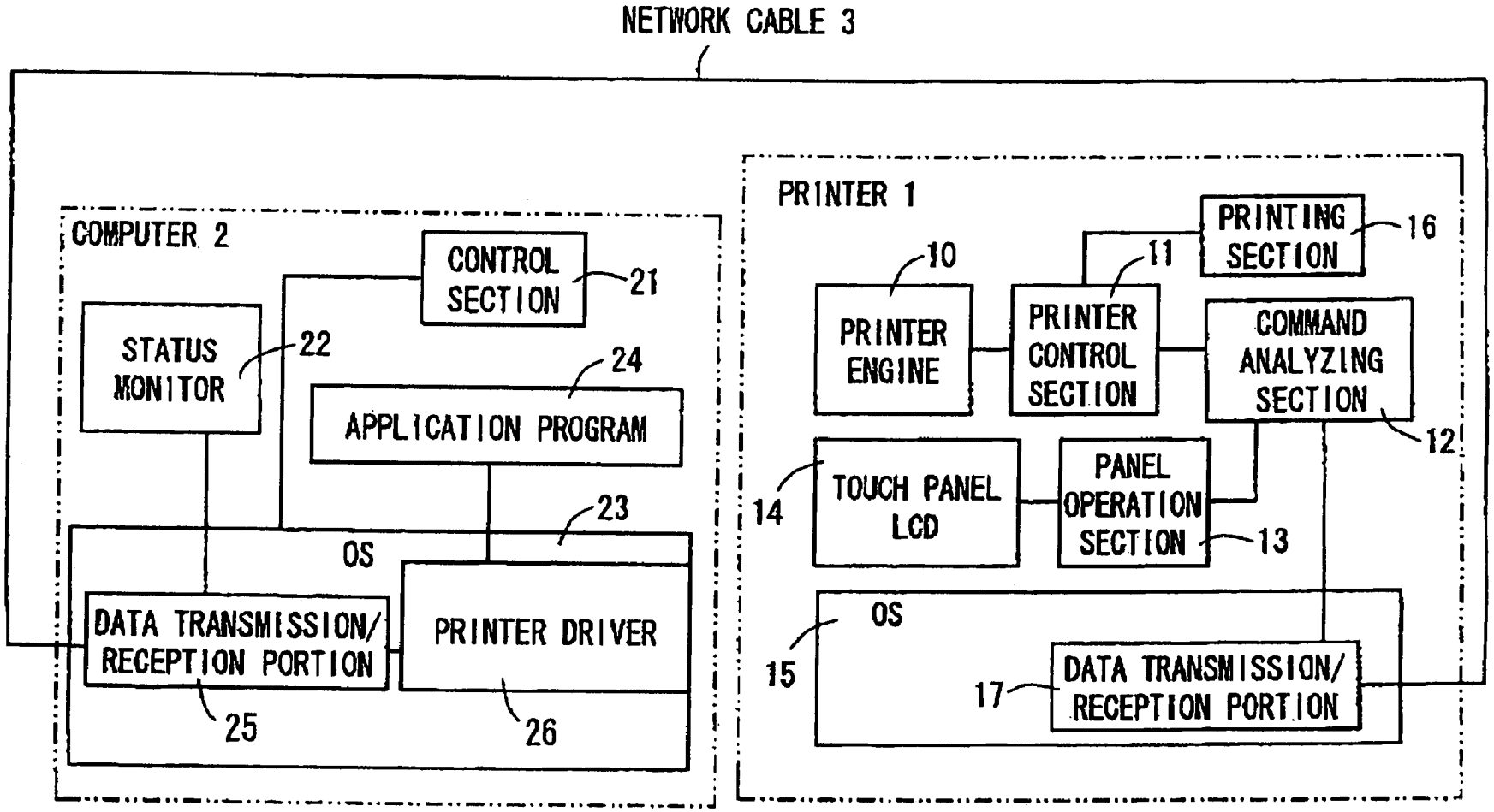
FIG. 1 is a block diagram showing the configurations of a printer and a computer.

Now referring to the drawings, preferred embodiments of the invention are described below.

FIG. 1 is a block diagram showing the configurations of a printer 1 and a computer 2. The printer 1, which is built as a printing apparatus including a printing control apparatus, is composed of a printer engine 10; a printer control section 11; a command analyzing section 12; a panel operation section 13; a touch panel LCD (Liquid Crystal Display) 14; an OS (Operation System) 15; and a printing section 16. The computer 2 is composed of a control section 21; a status monitor 22; an OS 23; and an application program 24.

The printer 1 and the computer 2 are connected to each other by way of a network cable 3. In the printer 1, a data transmission/reception portion 17 operates under the control of the OS 15. In the computer 2, a data transmission/reception portion 25 operates under the control of the OS 23. Data communications are carried out between these data transmission/reception portions 17 and 25.

In the computer 2, printing data including a printing command and image data are produced by the application program 24. The printing data is translated into printer language and is then sent to the printer 1 by a printer driver 26. In the printer 1, after the printing data is received, the printing command is analyzed by the command analyzing section 12. In the printer control section 11 acting as printing control means, the printer engine 10 and the printing section 16 are controlled, on the basis of the printing command thus analyzed, in such a way as to perform a printing operation with the image data subjected to appropriate image processing. The printing section 16 includes a sensor (detection means) for detecting whether a manual feeding tray, i.e. a paper feeding tray stocks a paper sheet or not. Through actuation of different function keys and the like mounted in the panel operation section 13, the user is able to perform various printing-related operations, such as setting of printing conditions and issuing an instruction to clear a print-standby condition, on the basis of the operational status displayed on the touch panel LCD 14.

Note that the printer control section 11, the command analyzing section 12, and the data transmission/reception portion 17 (in addition to that, the panel operation section 13 and the touch panel LCD 14 may be included as desired) constitute notification means, copy number indication means, and switching means.

Figure 2:
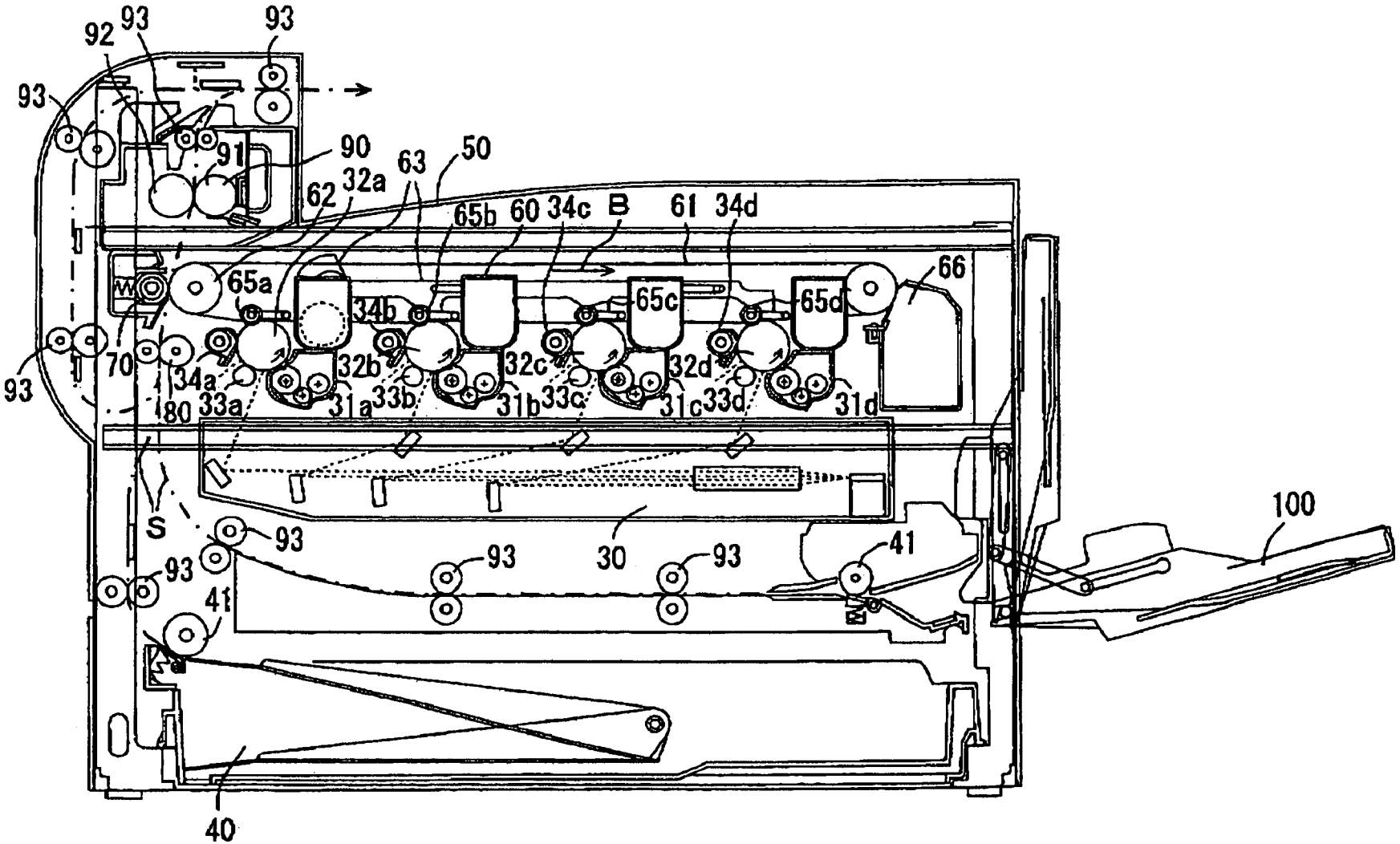
FIG. 2 is a sectional view showing the mechanical structure of the printer.

FIG. 2 is a sectional view showing the mechanical structure of the printer 1. The printer 1 is designed to form a multi-color or monochrome image onto a predetermined recording sheet (recording medium in sheet form) in response to image data received. As shown in FIG. 2, the printer 1 is mainly composed of an exposure unit 30; a development device 31; a photoconductive drum 32; a charging device 33; a cleaner unit 34; a sheet conveying path S; a sheet feeding tray 40; an ejected-sheet tray 50; an intermediate transfer belt unit 60; and a fixing unit 90.

The printer 1 deals with image data on color images represented by different colors: black (K); cyan (C); magenta (M); and yellow (Y). Hence, in order to form four latent images of different colors, the development device 31 (31*a*, 31*b*, 31*c*, and 31*d*), the photoconductive drum 32 (32*a*, 32*b*, 32*c*, and 32*d*), the charging device 33 (33*a*, 33*b*, 33*c*, and 33*d*), and the cleaner unit 34 (34*a*, 34*b*, 34*c*, and 34*d*) are each four in number. Note that the alphabet letters a, b, c, and d attached to the reference numerals represent black, cyan, magenta, and yellow, respectively. In this way, four units of image stations are constructed. The photoconductive drum 32 is arranged (mounted) in the upper part of the printer 1.

The charging device 33 serves as charging means for applying electric charge of predetermined potential evenly over the surface of the photoconductive drum 32. As shown in the figure, the charging device 33 may be realized by the use of a contact-type charging device in the form of a roller or brush. It is also possible to use a charger-type charging device therefor. As shown in the figure, the exposure unit 30 may be realized by the use of a laser scanning unit (LSU) having a laser irradiating portion and a reflecting mirror. It is also possible to use an EL (Electro Luminescence) write head constructed by arranging light-emitting elements in an array or LED (Light Emitting Diode) write head. In the exposure unit 30, the charged surface of the photoconductive drum 32 is exposed to light in accordance with image data inputted; wherefore an electrostatic latent image corresponding to the image data is created on the surface thereof. In the development device 31, the electrostatic latent image formed on the photoconductive drum 32 is visually developed with use of toner of different colors: K, C, M, and Y. The cleaner unit 34 removes and collects residual toner remaining on the surface of the photoconductive drum 32 after completion of development and image transfer operations.

Arranged above the photoconductive drum 23 is the intermediate transfer belt unit 60 composed of an intermediate transfer belt 61; an intermediate transfer belt driving roller 62; an intermediate transfer belt tension mechanism 63; an intermediate transfer belt follower roller 64; an intermediate transfer roller 65 (65*a*, 65*b*, 65*c*, and 65*d*); and an intermediate transfer belt cleaning unit 66.

The intermediate transfer belt driving roller 62, the intermediate transfer belt tension mechanism 63, the intermediate transfer belt follower roller 64, and the intermediate transfer roller 65 act to bring the intermediate transfer belt 61 into a stretched state so that it is driven to rotate in a direction indicated by the arrow B.

The intermediate transfer roller 65 is rotatably supported by an intermediate transfer roller mounting portion disposed in the intermediate transfer belt tension mechanism 63 of the intermediate transfer belt unit 60, for providing a transfer bias required to transfer the toner image formed on the photoconductive drum 32 onto the intermediate transfer belt 61.

The intermediate transfer belt 61 is so disposed as to make contact with all of the photoconductive drum 32 components. The toner images of different colors formed on the respective photoconductive drum 32 components are successively and superimposedly transferred onto the intermediate transfer belt 61, whereby a color toner image (multi-color toner image) can be formed on the intermediate transfer belt 61. The intermediate transfer belt 61 is designed as an endless belt formed of an approximately 100 to 150 μm-thick film.

The toner image is transferred from the photoconductive drum 32 to the intermediate transfer belt 61 by means of the intermediate transfer roller 65 disposed in contact with the back side of the intermediate transfer belt 61. In order to achieve transfer of the toner image, a high-voltage transfer bias (high voltage of a polarity (+) reverse to the polarity (−) of the charged toner) is applied to the intermediate transfer roller 65. The intermediate transfer roller 65 is basically formed of a metal (for instance, stainless) shaft which is 8 to 10 mm in diameter, and has its surface coated with an electrically conductive elastic material (for instance, EPDM or foamed urethane). By virtue of the conductive elastic material, a high voltage can be applied uniformly to the intermediate transfer belt. Although, in this embodiment, a roller-shaped configuration is adopted for the transfer electrode, a brush-shaped or other configurations may be used instead.

Then, the toner image, now visually developed on the respective photoconductive drum 32 components so as to exhibit different hues as described above, are stacked on top of each other on the intermediate transfer belt 61 in conformity with the image data inputted to the apparatus. In this way, the image data in the form of stacked images is transferred onto a paper sheet by means of a transfer roller 70 arranged in a contact area between the intermediate transfer belt 61 and the paper sheet as will be described later.

At this time, the intermediate transfer belt 61 and the transfer roller 70 are brought into contact with each other under a predetermined nip pressure. Simultaneously, a voltage (high voltage of a polarity (+) reverse to the polarity (−) of the charged toner) is applied to the transfer roller 70 to transfer the toner onto the paper sheet. In order to obtain the nip in a steady manner, of the transfer roller 70 and the intermediate transfer belt driving roller 62, one is made of a rigid material (metal material or the like) and the other is made of a pliant material such as an elastic roller (elastic rubber roller, foamed resin roller, or the like).

Moreover, the toner which adhered to the intermediate transfer belt 61 by contact with the photoconductive drum 32, or the toner which remains on the intermediate transfer belt 61 because of not being transferred onto a paper sheet by the transfer roller 70, could lead to a mixture of different toner colors in a subsequent process. In order to prevent this, such toner particles are removed and collected by the intermediate transfer belt cleaning unit 66. The intermediate transfer belt cleaning unit 66 is provided with a cleaning member which is brought into contact with the intermediate transfer belt 61, for example, a cleaning blade. That part of the intermediate transfer belt 61 which is contacted by the cleaning blade is supported, at its back, by the intermediate transfer belt follower roller 64.

The sheet feeding tray 40, on which paper sheets (recording sheets) for use in image formation are stacked, is disposed below the image forming section of the printer 1 and the exposure unit 30. Moreover, disposed in the upper part of the printer 1 is the ejected-sheet tray 50 on which paper sheets that have already undergone printing are placed in a face-down manner.

In addition, the printer 1 is provided with the sheet conveying path S for conveying the paper sheets placed on the sheet feeding tray 40 to the ejected-sheet tray 50 by way of the transfer roller 70 and the fixing unit 90. The sheet conveying path S is held in substantially a vertical position. In the vicinity of the sheet conveying path S ranging from the sheet feeding tray 40 to the ejected-sheet tray 50 are arranged a pick-up roller 41, the transfer roller 70, a resist roller 80, the fixing unit 90, a conveying roller 93 for conveying paper sheets, and so forth.

The conveying roller 93 is a small roller for facilitating and assisting conveyance of paper sheets. A plurality of conveying rollers 93 are arranged along the sheet conveying path S. The pick-up roller 41 disposed at the end of the sheet feeding tray 40 is designed as a retrieval roller by which paper sheets placed on the sheet feeding tray 40 are fed to the sheet conveying path S one by one.

After temporarily holding a paper sheet being conveyed along the sheet conveying path S, the resist roller 80 conveys the paper sheet to the transfer section with a timing such that the front end of the toner image formed on the photoconductive drum 32 conforms to the front end of paper sheet.

The fixing unit 90 is mainly composed of a heating roller 91 and a pressurizing roller 92. The heating roller 91 and the pressurizing roller 92 are driven to rotate while having sandwiched therebetween the paper sheet.

Under the control of the control section, the heating roller 91 is adjusted to exhibit a predetermined fixation temperature in response to a signal fed from a non-illustrated temperature detection device. By the synergistic actions of the heating roller 91 and the pressurizing roller 92, heat and pressure are applied to the paper sheet, whereby the multi-color toner image transferred onto the paper sheet are fused, mixed, pressurized, and are eventually thermally fixed onto the paper sheet.

The paper sheet carrying the multi-color toner image fixed thereon is then conveyed to part of the sheet conveying path S for getting ready to discharge the sheet in an upside-down manner. Eventually, the paper sheet is ejected onto the ejected-sheet tray 50 in a upside-down state (ejected with the multi-color toner image side up).

Next, the sheet conveying path will be explained in detail. In the printer 1 are arranged in advance a paper feeding cassette 40 for stocking paper sheets and a manual feeding tray 100. The manual feeding tray 100 saves the user from having to carry out the closing and opening of the paper feeding cassette 40 at the time of printing a small number of paper sheets.

In each of the above-described paper feeding means is arranged the pick-up roller 41 for directing paper sheets to the sheet conveying path one by one.

The paper sheet fed from the paper feeding cassette 40 is conveyed to the resist roller 80 by means of the conveying roller 93 arranged along the sheet conveying path. Then, the resist roller 80 conveys the paper sheet to the transfer roller 70 with a timing such that the front end of the paper sheet conforms to the front end of the image data carried on the intermediate transfer belt 61, whereby the image data can be recorded onto the paper sheet. After that, the paper sheet is moved to pass through the fixing unit 90, whereby the yet-to-be fixed toner deposited onto the paper sheet is fixed onto the paper sheet by thermal fusion. After passing through the conveying roller 93, the paper sheet is eventually ejected through an ejecting roller 94 onto the ejected-sheet tray 50.

On the other hand, the paper sheet stacked on the manual feeding tray 100 is supplied by means of the pick-up roller 41. The paper sheet is then conveyed to the resist roller 80 through a plurality of conveying rollers 93. From then on, the paper sheet follows the same path as the paper sheet fed from the paper feeding cassette, and is eventually ejected onto the ejected-sheet tray 50.

Attached to the manual feeding tray 100 is a paper sensor for detecting whether a paper sheet is placed on the tray or not. The status of the paper sensor is notified to the printer control section 11.

In the case where a double-sided printing mode is requested, after a single-sided printing process is completed as described above, the paper sheet having passed through the fixing unit 90 is moved, with its rear end gripped by the ejecting roller 94, toward the conveying roller 93 while the ejecting roller 94 is being rotated reversely. After that, the paper sheet is conveyed to the resist roller 80 so as to be subjected to a back-surface printing process. Upon completion of the double-sided printing process, the paper sheet is eventually ejected onto the ejected-sheet tray 50.

Figure 3:
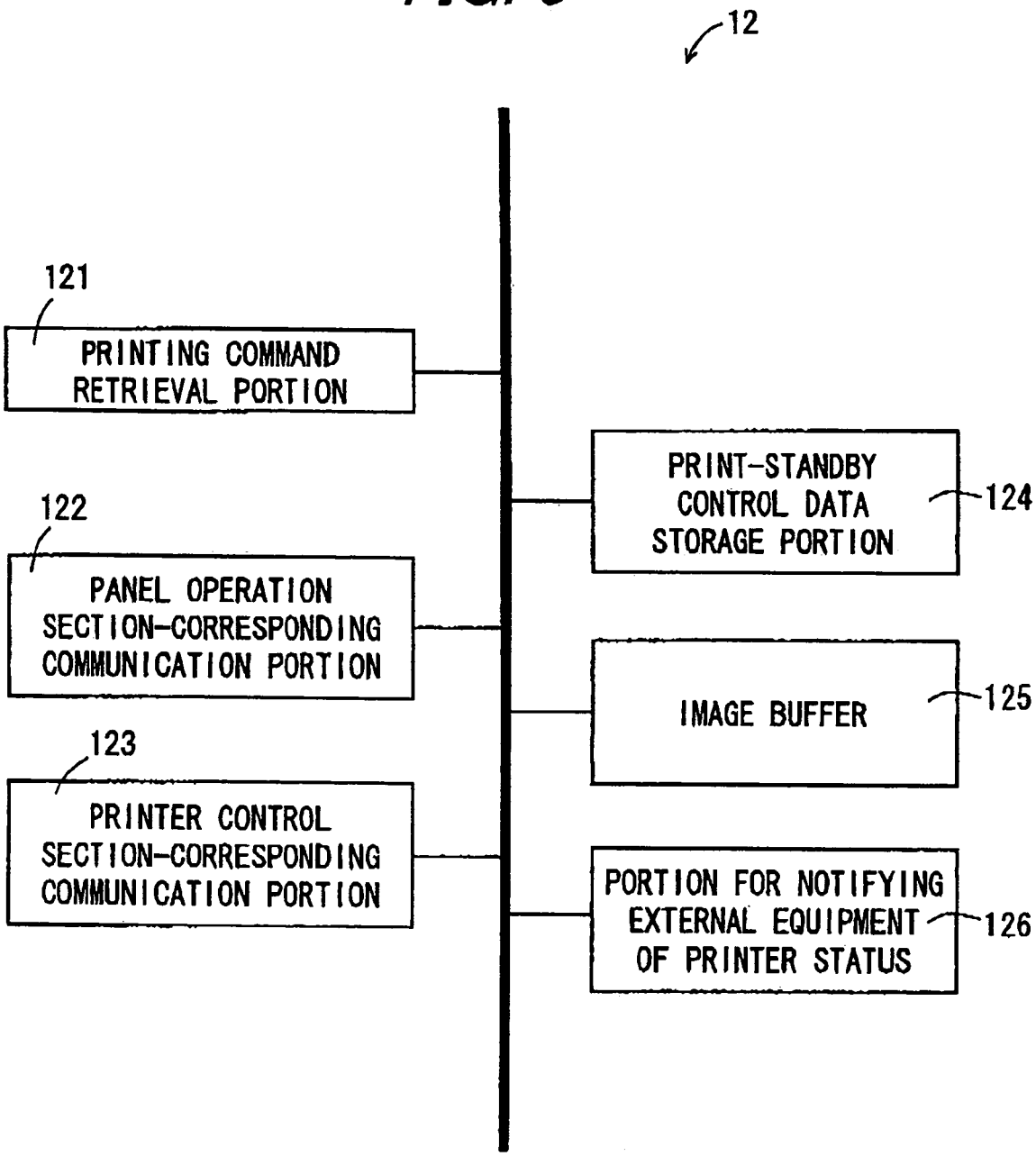
FIG. 3 is a block diagram showing the configuration of the command analyzing section.

FIG. 3 is a block diagram showing the configuration of the command analyzing section 12. The command analyzing section 12 is composed of a printing command retrieval portion 121; a panel operation section-corresponding communication portion 122; a printer control section-corresponding communication portion 123; a print-standby control data storage portion 124; an image buffer 125; and a notification portion for notifying external equipment of a printer status 126. The printing command retrieval portion 121 retrieves and analyzes a printing command of printing data received. The analytical result is sent out to the printer control section 11 and the panel operation section 13 by way of the panel operation section-corresponding communication portion 122 and the printer control section-corresponding communication portion 123. On the basis of each command included in the printing command, the print-standby control data storage portion 124 stores therein print-standby control data (as will be described in detail later). The image buffer 125 keeps received image data stored therein until a printing operation is completed. By the notification portion for notifying external equipment of a printer status 126, the status of the printer 1, such as whether the printer 1 is placed in the manual-feeding standby state or not, is notified to the computer 2 that sent the print data to the printer 1. In response to the notification, the computer 2 is driven to put out the status of the printer 1 for display on the status monitor 22.

Figure 4:
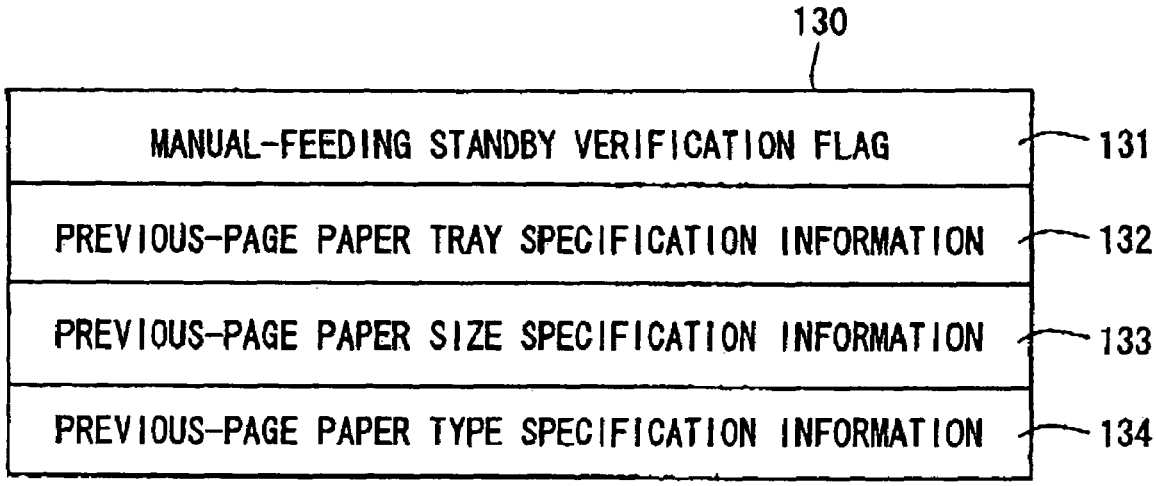
FIG. 4 is a view showing the constitution of the print-standby control data.

FIG. 4 is a view showing the constitution of the print-standby control data 130. The print-standby control data 130 includes a manual-feeding standby verification flag 131; previous-page paper tray specification information 132; previous-page paper size specification information 133; and previous-page paper type specification information 134. The manual-feeding standby verification flag 131 is indicative of whether or not the user has already done a ready-to-standby operation to perform paper setting, for example, whether or not the manual-feeding tray is specified or whether or not a standby condition is specified by a standby specification command. The previous-page paper tray specification information 132 is indicative of a paper tray specified with respect to a page previous to a current page being processed. The previous-page paper size specification information 133 is indicative of a paper size specified with respect to a page previous to a current page being processed. For example, the paper-size specification information refers to A3, A4, B5, and so forth. The previous-page paper type specification information 134 is indicative of a paper type specified with respect to a page previous to a current page being processed. For example, the paper-type specification information refers to the appearance, namely, coating status or thickness of a print sheet, such as plain paper, calendered paper, or overhead transparency film (OHP sheet).

Figure 5:
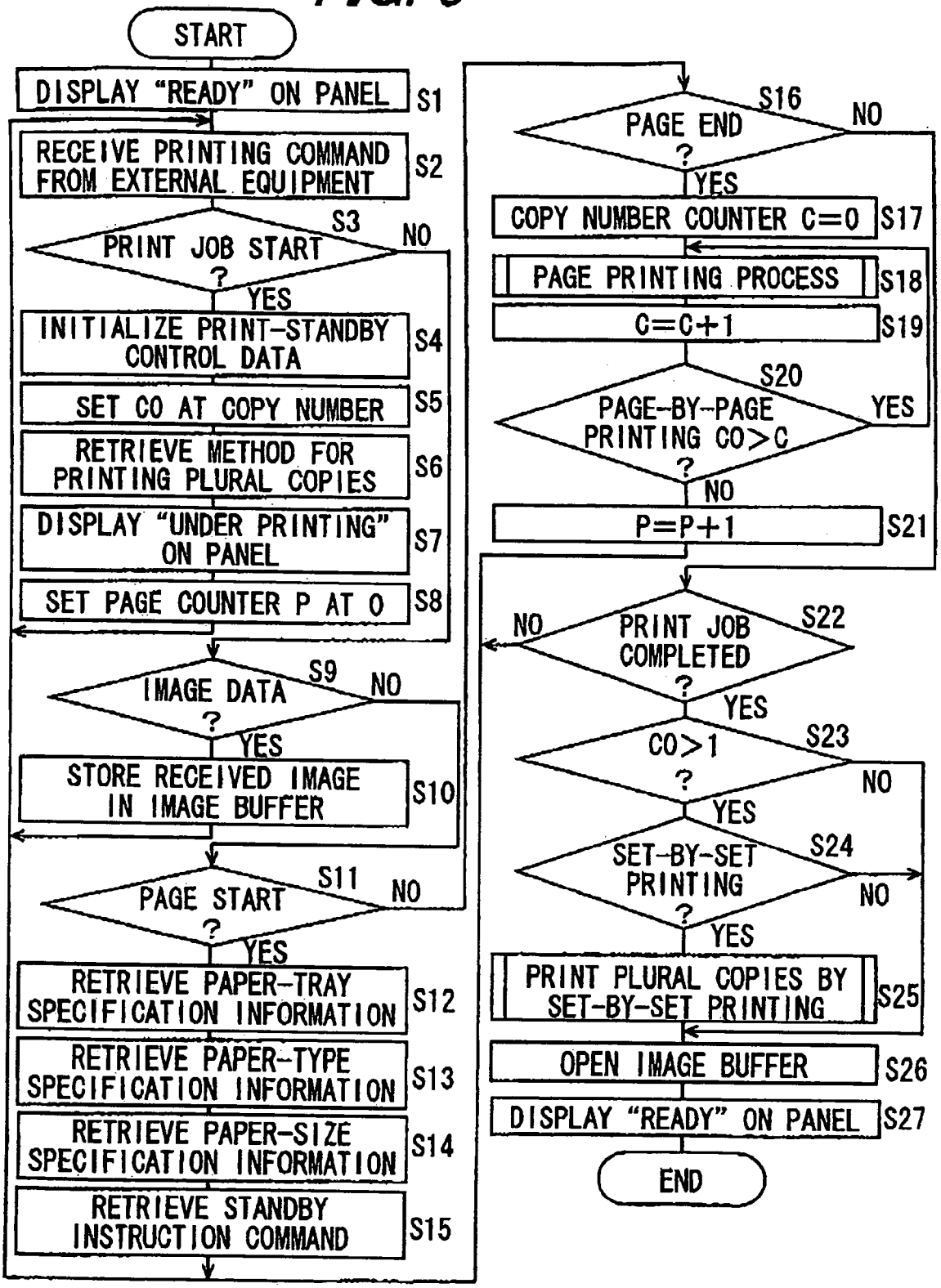
FIG. 5 is a flow chart illustrating the procedure for performing a printing operation with use of the printer.

FIG. 5 is a flow chart illustrating the procedure for performing a printing operation with use of the printer 1. The printing process will be started upon turning the power of the printer 1 on.

Figure 6:
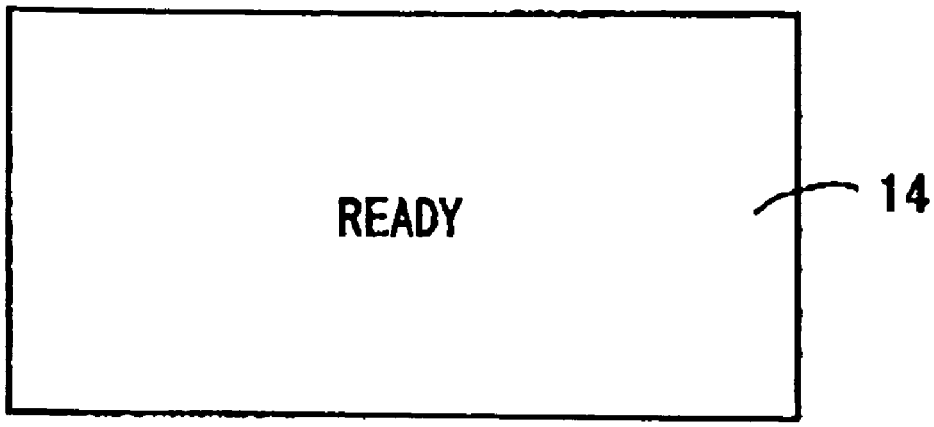
FIG. 6 is a view showing an example for display screen on a touch panel LCD.

In Step S1, as shown in FIG. 6, "READY" is displayed on the touch panel LCD 14 for notifying an operator that the printer is ready for use. In Step S2, a printing command sent out from external equipment or the computer 2 is received. In Step S3, a check is made to determine whether or not the command received is a job start command, and, if so, the procedure proceeds to Step S4, but, if not, the procedure proceeds to Step S9.

In Step S4, initialization is executed to clear the print-standby control data 130 stored in the print-standby control data storage portion 124. In Step S5, the number of copies is set at C0. In Step S6, a method for printing a plurality of sets of copies is retrieved. With regard to this two methods will be considered, i.e. set-by-set printing and page-by-page printing. The set-by-set printing is so-called collation printing. In a collation printing process, a set of pages arranged in accordance with page numbers is produced in a number corresponding to the number of copies. On the other hand, in a page-by-page printing process, each of all pages is successively printed in a number corresponding to the number of copies.

Figure 7:
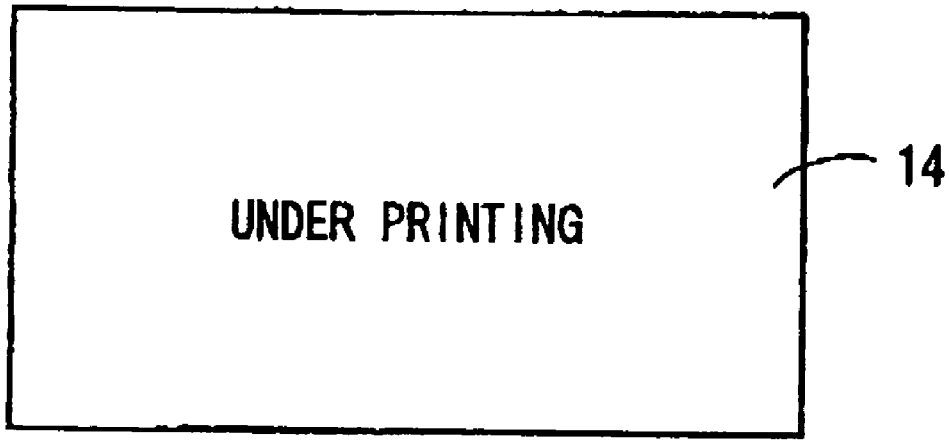
FIG. 7 is a view showing an example for display screen on a touch panel LCD.

In Step S7, as shown in FIG. 7, in response to the job start command, "UNDER PRINTING" is displayed on the touch panel LCD 14 for notifying the operator that a printing operation is started. In Step S8, a page counter P is set at 0. Note that such information as the number of copies to be printed, the printing methods, and the page counter is stored in non-illustrated storage means.

In Step S9, a check is made to determine whether or not image data is received, and, if so, the procedure proceeds to Step S10, but, if not, the procedure proceeds to Step S11. In Step S10, the image data received is stored in the image buffer 125.

In Step S11, a check is made to determine whether or not a page start command is received, and, if so, the procedure proceeds to Step S12, but, if not, the procedure proceeds to Step S16. In Step S12, paper-tray specification information is retrieved. In Step S13, paper-type specification information is retrieved from a medium condition setting command. In Step S14, paper-size specification information is retrieved from the medium condition setting command. In Step S15, a standby specification command is retrieved. Note that, in this embodiment, in order to place the printer in a manual-feeding standby state to carry out paper changing, a standby-effecting instruction is issued by specifying the manual feeding tray as a paper sheet tray and by sending out a standby specification command to effect the manual-feeding standby as well. In the alternative, the standby-effecting instruction can also be issued only by specifying the manual feeding tray, or only by sending out the standby specification command.

In Step S16, a check is made to determine whether or not a page end command is received, and, if so, the procedure proceeds to Step S17, but, if not, the procedure proceeds to Step S22. In Step S17, a value C of a copy number counter is set at 0. In Step S18, a page printing process is performed to print image data corresponding to a single page. In step S19, a number of 1 is added to a current value counted by the copy number counter. In Step S20, a check is made to determine whether or not the page-by-page printing is selected and whether or not the value C of the copy number counter is less than C0. If these conditions are fulfilled, the procedure proceeds to Step S21. If these conditions are not fulfilled, the procedure returns to Step S18. In Step S21, a number of 1 is added to a current value counted by the page counter. Then, the procedure returns to Step S2.

In Step S22, a check is made to determine whether or not a print-job completion command is received, and, if so, the procedure proceeds to Step S23, but, if not, the procedure returns to Step S2. In Step S23, a check is made to determine whether or not the copy number C0 is larger than 1. When the copy number C0 is larger than 1, the procedure proceeds to Step S24. When the copy number C0 is equal to 1, the procedure proceeds to Step S26. In Step S24, a check is made to determine whether or not the set-by-set printing is selected, and, if so, the procedure proceeds to Step S25, but, if not, the procedure proceeds to Step S26. In Step S25, a plurality of sets are printed in accordance with the set-by-set printing process. In Step S26, the image buffer 125 is opened to be accessible. In Step S27, "READY" is displayed on the touch panel LCD 14, and the procedure comes to an end.

Figure 8B:
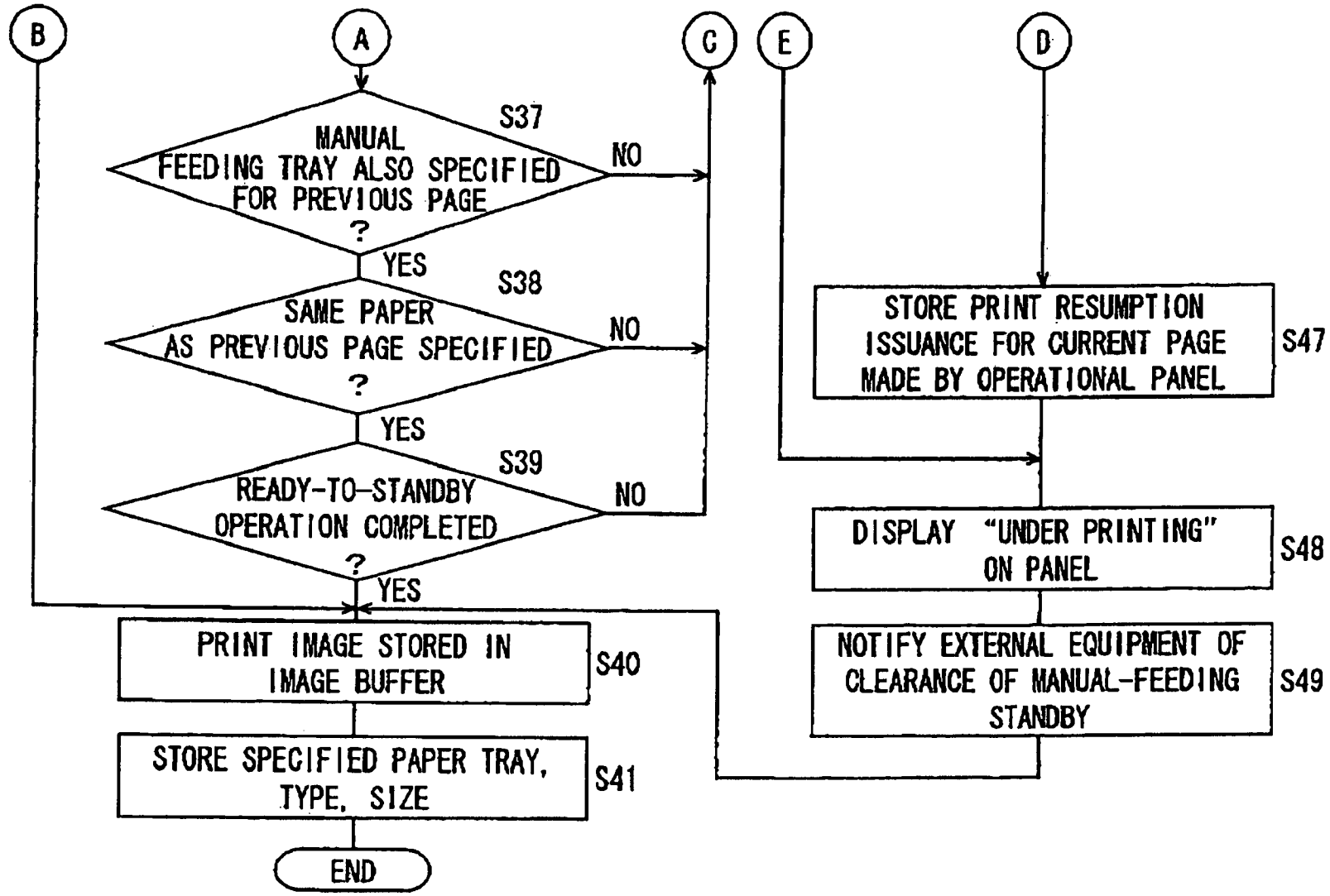
FIG. 8 is a flow chart illustrating the procedure for performing the page printing process.

FIG. 8 is a flow chart illustrating the procedure for performing the page printing process. In Step S31, a check is made to determine, in the case of specifying the manual-feeding standby, whether print standby is allowed or not. If allowed, the procedure proceeds to Step S32. If not allowed, the procedure proceeds to Step S40. The selection between permission and prohibition of print standby can be made by the user through an input operation. In Step S32, a check is made to determine whether or not the page-by-page printing is specified and whether or not the value C of the copy number counter is greater than 0. If these conditions are fulfilled, the procedure proceeds to Step S40. If these conditions are not fulfilled, the procedure proceeds to Step S33. In Step S33, a check is made to determine whether or not the set-by-set printing is specified and whether or not the value C of the copy number counter is greater than 0. If these conditions are fulfilled, the procedure proceeds to Step S34. If these conditions are not fulfilled, the procedure proceeds to Step S36. In Step S34, a check is made to determine whether or not a print resumption instruction is issued by the operational panel during the course of printing a current page corresponding to a previous set of copies, and, if so, the procedure proceeds to Step S40, but, if not, the procedure proceeds to Step S35.

The manual-feeding standby needs to be cleared to resume the printing operation. To achieve this, in this embodiment, two methods will be considered, i.e. inputting a necessary instruction by the operational panel under the control of the user and indicating the placement of a new paper sheet by means of the paper sensor disposed in the vicinity of the manual feeding tray. With the print resumption instruction issued by the operational panel during the course of printing a current page corresponding to a previous set of copies, it can be considered that the user did not carry out paper changing. Hence, if, in Step S34, it is judged that the print resumption instruction was issued by the operational panel, it will be determined that there is no need to place the printer in a standby state for the purpose of paper changing. Then, the procedure proceeds to Step S40 where the current page is printed.

In Step S35, a check is made to determine whether or not the manual feeding tray is specified as a paper tray, and, if so, the procedure proceeds to Step S36, but, if not, the procedure proceeds to Step S40. In Step S36, a check is made to determine whether or not the decision as to the paper tray specified with respect to the previous page is permitted, and, if so, the procedure proceeds to Step S37, but, if not, the procedure proceeds to Step S40. In Step S37, a check is made to determine whether or not the manual feeding tray was also specified with respect to the previous page, and, if so, the procedure proceeds to Step S38, but, if not, the procedure proceeds to Step S42. In Step S38, a check is made to determine whether or not the same paper size and type as specified with respect to the previous page are specified, and, if so, the procedure proceeds to Step S39, but, if not, the procedure proceeds to Step S42. In Step S39, a check is made to determine whether or not a ready-to-standby operation was performed with reference to the manual-feeding standby verification flag, and, if so, the procedure proceeds to Step S40, but, if not, the procedure proceeds to Step S42.

In Step S40, the image data corresponding to the current page stored in the image buffer 125 is printed. In Step S41, the print-standby control data 130 is overwritten with the data of the paper tray, paper size, and paper type specified with respect to the current page. The updated data is kept stored. In Step S42, the manual-feeding standby verification flag 131 is set in such a way that the ready-to-standby operation has been completed. In Step S43, as shown in FIG. 9, "STANDBY FOR MANUAL FEEDING" is displayed on the touch panel LCD 14 for indicating that the printer is now placed in a standby state. In Step S44, the standby status is notified to external equipment or the computer 2. In response to the notification, the computer 2 is driven to put out the manual-feeding standby status for display on the status monitor 22, as shown in FIG. 10. In addition to the current status of the printer, as shown in FIG. 10, it is preferable that the paper size and type as specified with respect to the current page under printing are also displayed.

In Step S45, a check is made to determine whether or not a paper sheet is re-placed on the manual feeding tray, and, if so, the procedure proceeds to Step S48, but, if not, the procedure proceeds to Step S46. In Step S46, a check is made to determine whether or not the print resumption instruction is issued from the operational panel under the operation of the user, and, if so, the procedure proceeds to Step S47, but, if not, the procedure returns to Step S45. In Step S47, the issuance of the print resumption instruction by the operational panel with respect to the current page is stored in a predetermined storage region. In Step S48, "UNDER PRINTING" is displayed on the touch panel LCD 14. In Step S49, external equipment or the computer 2 is notified that the standby condition was cleared. Then, the procedure proceeds to Step S40.

Figure 11:
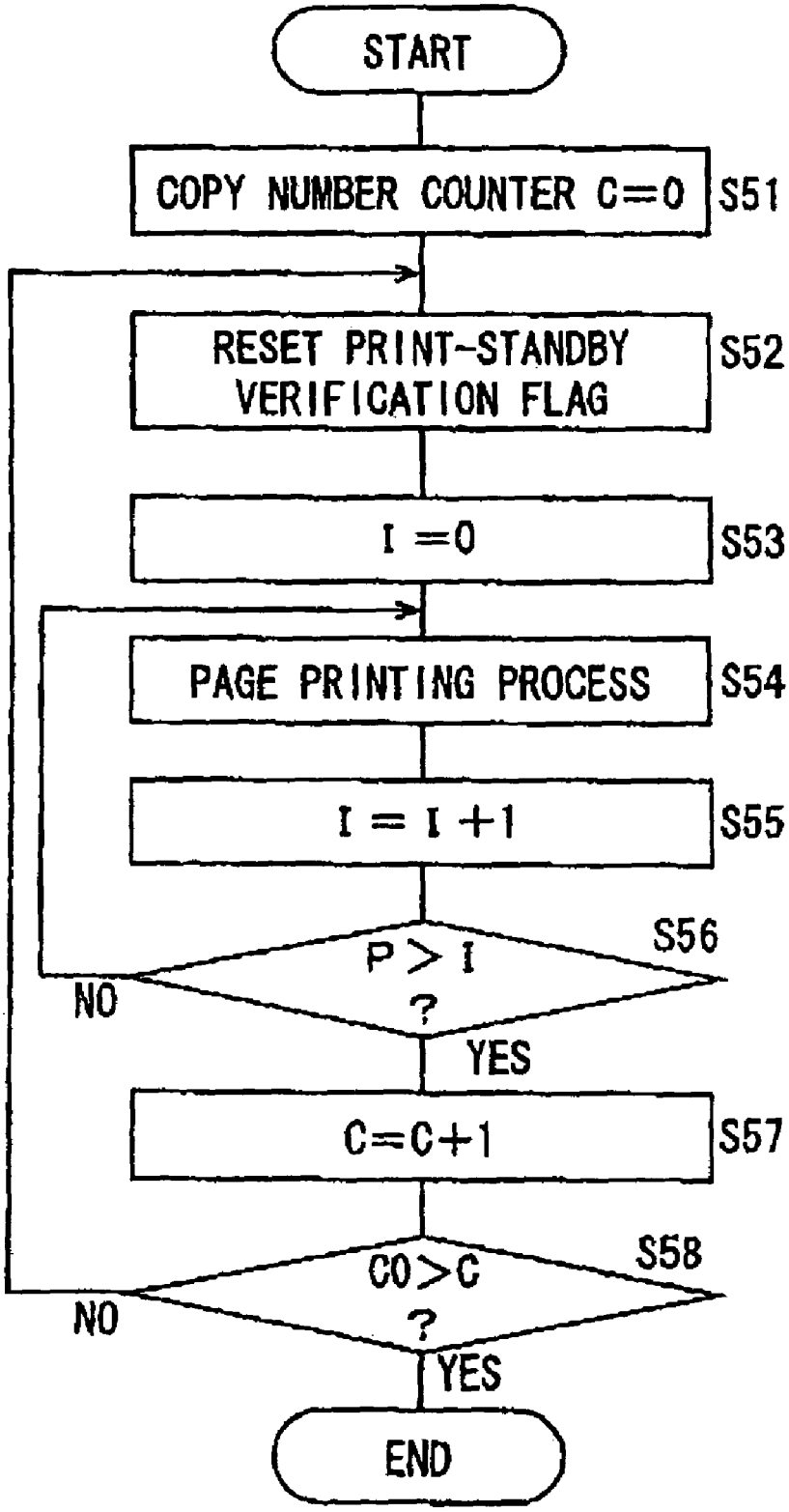
FIG. 11 is a flow chart illustrating the procedure for printing a plurality of sets of copies in accordance with the set-by-set printing process.

FIG. 11 is a flow chart illustrating the procedure for printing a plurality of sets of copies in accordance with the set-by-set printing process. In Step S51, the value C of the copy number counter is set at 0. In Step S52, the print-standby verification flag is reset. In Step S53, a counter I is set at 0. In Step S54, the page printing process is performed. In Step S55, a number of 1 is added to the current value counted by the counter I. In Step S56, a check is made to determine whether or not the value counted by the page counter P is greater than the value counted by the counter I. If the value of P is greater than that of I, the procedure proceeds to Step S57. If the value of P is equal to or less than that of I, the procedure returns to Step S54. In Step S57, a number of 1 is added to the current value C of the copy number counter. In Step S58, a check is made to determine whether or not the copy number value C0 is greater than the value C of the copy number counter. If the copy number value C0 is greater than the value C, the procedure comes to an end. If the copy number value C0 is equal to or less than the value C, the procedure returns to S52.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A printing control apparatus that receives a printing command associated with a printing operation and image data extending over a plurality of pages of a print target and exercise paper-feeding control based on the printing command received, to a printing apparatus equipped with a paper feeding tray for stocking a plurality of sheet-like recording media, the printing command including a standby specification command for allowing a print-standby condition to be specified with respect to the image data on a page-by-page basis, wherein the printing command includes a medium condition setting command for setting a medium condition as to a sheet-like recording medium, the printing control apparatus comprising:

detection means for detecting an instruction to resume printing which is on standby because of specification of the print-standby condition by the standby specification command; and control means for controlling the printing apparatus in such a way that print standby is effected with respect to one of a plurality of image-data pages that has been subjected to print-standby specification in the first place by the standby specification command, and, after a print resumption instruction is detected, only when the page to which standby has been specified in the first place by the standby specification command and pages subsequent thereto are equal in condition setting by the medium condition setting command, automatically controlling the printing apparatus such that print standby is not effected with respect to the image-data pages of the second and later copies even if standby is specified by the standby specification command.

2. The printing control apparatus of claim 1, wherein the medium condition refers to the size of the sheet-like recording medium.

3. The printing control apparatus of claim 1, wherein the medium condition refers to a type of the sheet-like recording medium.

4. The printing control apparatus of claim 1, further comprising switching means for allowing selection between permission and prohibition of control action performed by the control means.

5. The printing control apparatus of claim 1, wherein the control means has notification means for notifying, in a case of effecting print standby, external equipment of readiness for standby.

6. A printing apparatus incorporating the printing control apparatus of claim 1.

7. A printing control apparatus that receives a printing command associated with a printing operation and image data extending over a plurality of pages of a print target and exercise paper-feeding control based on the printing command received, to a printing apparatus equipped with a paper feeding tray for stocking a plurality of sheet-like recording media, the printing command including a standby specification command for allowing a print-standby condition to be specified with respect to the image data on a page-by-page basis, wherein the printing command includes a medium condition setting command for setting a medium condition as to a sheet-like recording medium, the printing control apparatus comprising:

copy number specification means for giving an instruction to the printing apparatus to print a plurality of sets of copies;

detection means for detecting an instruction to resume printing which is on standby because of specification of the print-standby condition by the standby specification command; and control means for controlling the printing apparatus in such a way that print standby is effected with respect to one of a plurality of image-data pages the first copy that has been subjected to print-standby specification in the first place by the standby specification command, and, after a print resumption instruction is detected, only when the page to which standby has been specified in the first place by the standby specification command and pages subsequent thereto are equal in condition setting by the medium condition setting command, automatically controlling the printing apparatus such that print standby is not effected with respect to the image-data pages of the second and later copies even if standby is specified by the standby specification command.

8. The printing control apparatus of claim 7, further comprising switching means for allowing selection between permission and prohibition of control action performed by the control means.

9. The printing control apparatus of claim 7, wherein the control means has notification means for notifying, in a case of effecting print standby, external equipment of readiness for standby.

10. A printing apparatus incorporating the printing control apparatus of claim 7.

11. A printing control method comprising the steps of:

receiving a printing command associated with a printing operation and image data extending over a plurality of pages of a print target; and exercising paper-feeding control based on the printing command received, to a printing apparatus equipped with a paper feeding tray for stocking a plurality of sheet-like recording media, wherein the printing command includes a standby specification command for allowing a print-standby condition to be specified with respect to the image data on a page-by-page basis, wherein the printing command includes a medium condition setting command for setting a medium condition as to a sheet-like recording medium, the printing control method further comprising the steps of:

controlling the printing apparatus such that print standby is effected with respect to one of a plurality of image-data pages that has been subjected to print-standby specification in the first place by the standby specification command; and after a print resumption instruction for standby print is detected, only when the page to which standby has been specified in the first place by the standby specification command and pages subsequent thereto are equal in condition setting by the medium condition setting command, automatically controlling the printing apparatus such that print standby is not effected with respect to the image-data pages of the second and later copies even if standby is specified by the standby specification command.

12. A computer-readable recording medium encoded with a printing control program for use in driving a computer to execute the printing control method of claim 11.

13. A printing control method comprising the steps of:

receiving a printing command associated with a printing operation and image data extending over a plurality of pages of a print target; and exercising paper-feeding control based on the printing command received, to a printing apparatus equipped with a paper feeding tray for stocking a plurality of sheet-like recording media, wherein the printing command includes a standby specification command for allowing a print-standby condition to be specified with respect to the image data on a page-by-page basis, wherein the printing command includes a medium condition setting command for setting a medium condition as to a sheet-like recording medium, the printing control method further comprising the steps of:

when printing of a plurality of sets of copies is instructed, controlling the printing apparatus such that print standby is effected with respect to one of a plurality of image-data pages for the first copy that has been subjected to print-standby specification in the first place by the standby specification command; and after an instruction to resume printing on standby has been detected, only when the page to which standby has been specified in the first place by the standby specification command and pages subsequent thereto are equal in condition setting by the medium condition setting command, automatically controlling the printing apparatus such that print standby is not effected with respect to the corresponding page for the second and later copies even if standby is specified by the standby specification command.

14. A computer-readable recording medium encoded with a printing control program for use in driving a computer to execute the printing control method of claim 13.

* * * * *